United States Patent [19]

Kameyama et al.

[11] 4,112,407

[45] Sep. 5, 1978

[54] FIRE SENSING DEVICE

[75] Inventors: Yasuyoshi Kameyama, Kobe; Satoru Suzaki, Suita, both of Japan

[73] Assignee: Matsushita Electric Works, Ltd., Osaka, Japan

[21] Appl. No.: 791,489

[22] Filed: Apr. 27, 1977

[30] Foreign Application Priority Data

Jul. 30, 1976 [JP] Japan ..... 51-91822

[51] Int. Cl.[2] ..... H01H 37/46

[52] U.S. Cl. ..... 337/398; 340/593

[58] Field of Search ..... 337/393, 396, 398, 403, 337/407, 409, 414, 416; 340/227.1

[56] References Cited

U.S. PATENT DOCUMENTS

| | | | |
|---|---|---|---|
| 1,117,347 | 11/1914 | Dixon | 337/396 |
| 1,179,276 | 4/1916 | Bullock | 340/227.1 |
| 2,824,300 | 2/1958 | Rand | 340/227.1 X |
| 3,391,402 | 7/1968 | Lucas et al. | 340/227.1 |

*Primary Examiner*—George Harris

*Attorney, Agent, or Firm*—Leydig, Voit, Osann, Mayer & Holt, Ltd.

[57] ABSTRACT

A fire sensing device for actuating associated fire alarm system having a heat receiving plate member of improved heat receiving efficiency for rapidly transmitting any abnormal heat received from environmental atmosphere to a heat-responsive switching means thermally connected to the plate member to actuate the alarm system promptly and reliably is provided. In order to enlarge surface area, the heat receiving plate member has many fins comprising elongated bridging parts defined by adjacent ones of many parallel slits made in the plate member and twisted about elongated axis preferably by an angle of 40° to 60° with respect to the plane of the plate member so as to be raised at both longitudinal edges from the member on its both sides, whereby abnormally heated air passing along a surface or surfaces of the plate member is caused to flow along the fins through or into the slits to rapidly and efficiently transmit its heat to the plate member.

5 Claims, 7 Drawing Figures

FIRE SENSING DEVICE

This invention relates to fire sensing devices to be used for detecting any abnormal heat generation or fire occurrence to actuate a fire alarm system and, more particularly, to improvements in such fire sensing devices that are provided with a heat receiving plate member assembled in heat-responsive switch section of the device for the purpose of elevating heat receiving efficiency of the heat-responsive switch section and thus improving the sensitivity of the device to the heat.

Heretofore, the heat receiving plate member provided in the fire sensing devices of the kind referred to has been made of a plate metal having a high thermal conductivity and provided with a plurality of slits or apertures properly made in a region expanding radially from a central section at which the plate member is thermally connected to the heat-responsive switch so that the plate member could receive heated air flow on both surfaces of the plate metal and the heat of the air would be transmitted to the heat-responsive switch section. In the heat receiving plate member of such structure as above, however, effective area for receiving the heat has been small and, specifically when the heated air flow has a directivity to be in parallel to the respective surfaces of the plate member, the most of the air flow would pass over the member without contacting with the same, so that expected contribution of the member to the elevation of the heat receiving efficiency has been insufficient.

According to the present invention, the above described problem has been successfully solved by provisions in the fire sensing device of a heat-responsive switch section and a heat receiving plate member coupled at its central part to the switch section and expanding around the same, in which plate member at least two groups of slits defined by a plurality of fins raised in the same direction so that the slits of each group will be oriented in the same direction, and the said at least two groups of the slits include at least two groups of the fins in each group of which the fins are raised in different direction from those in the other group.

A primary object of the present invention, therefore, to provide a fire sensing device having a larger contacting area of the heat receiving plate member with the heated air flow so that the plate member will be heated quickly by the heated air flow and thereby responding rate of the device to the heat will be made higher.

Another object of the present invention is to provide a fire sensing device wherein the heat receiving plate member can be rapidly heated by the heated air flow which flows in any of directions along ceiling surface of a room in which the device is installed.

Other objects and advantages of the present invention shall be made clear upon reading the following disclosure detailed with reference to a preferred embodiment of the invention shown in accompanying drawings, in which.

Figure 1:
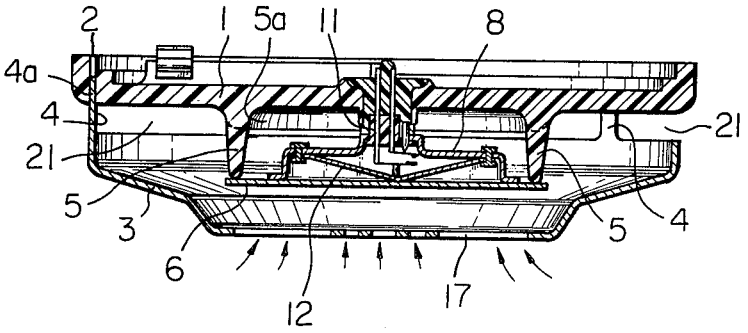
FIG. 1 is a vertically sectioned view of an embodiment of the fire sensing device according to the present invention.

While the invention shall be referred to with reference to the particular embodiment thereof shown in the drawings, it is not intended to limit the invention to such embodiment but to include all possible modifications, alterations and equivalent arrangements to be included in the scope of appended claims.

Figure 2:
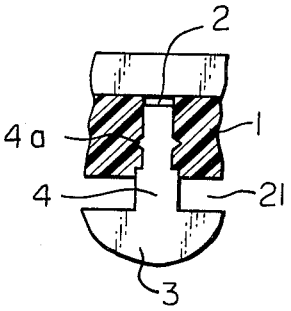
FIG. 2 is a fragmentary enlarged view with a part in section of the device shown in FIG. 1, showing coupling part of covering member to base member.

Referring first to FIG. 1 showing an embodiment of the fire sensing device of the present invention in section, 1 is a base member or body made of an electrically insulative material in a substantially disk shape, the material of which is preferably such a synthetic resin as urea resin, premixed molding compound or the like, and the body 1 is provided with a plurality of recesses or slits 2 in the present case adjacent peripheral edge of the disk-shaped body so as to lie in vertical direction with respect to expanding plane of the body 1. A substantially saucer-shaped covering member 3 for later described main parts of the device is provided with a plurality of upright extensions 4 on peripheral edge so that the respective extensions 4 will be fitted into each of the slits 2 for a part of entire length, whereby the covering member 3 is mounted to the body 1 with sideward apertures 21 remained as a clearance between the member 3 and the body 1. It is preferable that the slits 2 and extensions 4 are as less as possible in number so that clearance area of the apertures 21 will be as larger as possible and, thus, in the present instance three of the slits 2 as well as the extensions 4 are provided as spaced by radial intervals of 120°. Further, as seen in FIG. 2, each of the extensions 4 is preferably provided with lateral projections 4*a* on both sides so that securing force of the covering member 3 to the body 1 will be elevated.

On one surface of the body 1 which is covered by the covering member 3, there are provided a plurality of columnar projections or legs 5 of the same length and at predetermined intervals. In the present invention, as the most preferable embodiment, four of the legs 5 are provided as equally spaced, so as to extend downward in the drawing and over the midst of enclosed space inside the covering member 3, and a disk-shaped heat receiving plate member 6 made of a highly thermo-conductive metal and painted black is fitted at its parts adjacent the periphery to bottom ends of the respective legs 5. The plate member 6 has at least a pair of holes 7 at opposing positions adjacent the periphery so that the member 6 will be secured to the body 1 by means of screws or rivets (not shown) passed through the holes 7. On one surface of the plate member 6 facing the body 1 as spaced therefrom by the legs 5, a rectangular casing 8 of a material high in thermal expansion coefficient and opened one one side is soldered to the central part of the member 6 at an end of the opened side of the casing 8, and on the other side of the casing 8 facing the body 1 there is provided an aperture, which is closed by a junction base 11 including a movable contact leaf 9 and stationary contact leaf 10 made integral by means of a molding and protruding centrally from the body 1.

Figure 4:
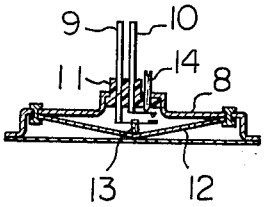
FIG. 4 is a vertically sectioned view of a heat-responsive expander block employed in the device of FIG. 1.
Figure 5:
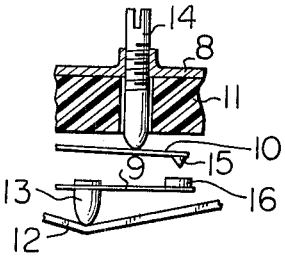
FIG. 5 is an enlarged fragmentary view in section of main parts in the expander block of FIG. 4.

Further, inside the casing 8, a pantograph member 12 of a material having a thermal expansion coefficient lower than that of the casing 8 is hung as fixed at both ends to the casing 8 over an insulative piece 13 secured to a bent part having a movable contact 16 at an end of the movable contact leaf 9. Further, an adjusting screw 14 is screwed into a threaded hole in upper edge of the casing 8 so that the tip end of the screw 14 will abut a bent part having a stationary contact 15 of the stationary contact leaf 10 so as to be able to urge the bent part of the stationary contact 15 toward the opposing bent part with the movable contact leaf 9. Thus, opposing clearance between the stationary and movable contacts 15 and 16 is adjustable by means of the screw 14 which will be screwed in or out (see also FIGS. 4 and 5). Between the respective legs 5, there are formed respectively arcuate walls 5*a* so that they will form a shallow ling-shaped projection as a whole of the body 1 connecting the respective legs 5 at their base parts. The walls 5*a* are effective to cause a heated air flow coming from any lateral side of the device along the ceiling surface to which the body 1 of the device is mounted to be directed toward the heat receiving plate member 6 and also to prevent heat receiving efficiency of the plate member 6 from being lowered even when the plate member is provided to be closer to the body 1. As seen in FIG. 1, further, a plurality of apertures 17 are provided in bottom part of the saucer-shaped covering 3 for free circulation of the heated air flow through the covering.

Figure 3:
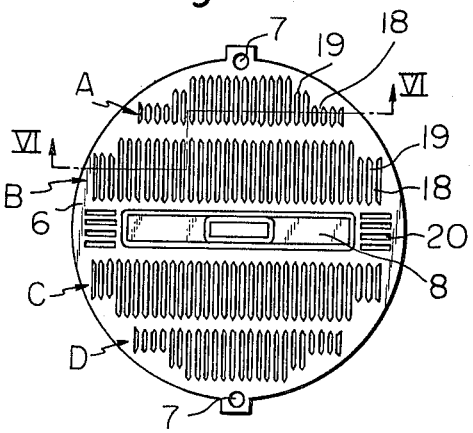
FIG. 3 is a plan view of a heat receiving plate member employed in the device of FIG. 1.
Figure 6:
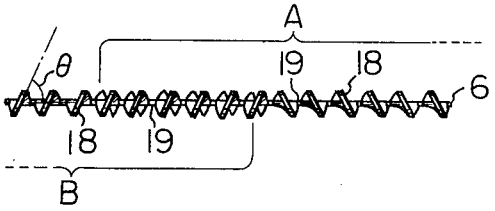
FIG. 6 is a sectioned view of the heat receiving plate member along line VI-VI in FIG. 3.
Figure 7:
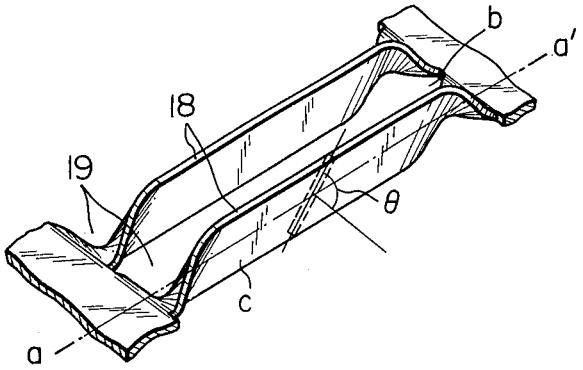
FIG. 7 is a fragmentary perspective view as magnified of the heat receiving plate member according to the present invention, showing details of fins provided in the plate member.

Referring more in detail to the heat receiving plate member 6 with reference to FIGS. 3, 6 and 7, the plate member 6 is provided with a number of fins 18 in the field between the central part to which the casing 8 is secured and the peripheral edge of the plate member 6, and these fins 18 are formed by raising or twisting respective elongated parts of the plate member defined by respective parallel slits so that the elongated parts as twisted will form an angle $\theta$ with respect to the plane of the plate member as shown in FIG. 6 or 7. More precisely, the respective fins 18 comprise, as will be best seen in FIG. 7, elongated bridge part *c* defined by adjacent parallel slits *b* made in the plate member 6 and twisted about its longitudinal axis *a–a'* so that both side edges will project out of both surfaces of the plate member 6 forming between adjacent fins many apertures 19 and thereby the respective fins 18 are caused to be able to catch heated air flows on the both sides of the plate member 6. These fins 18 as well as the apertures 19 are preferably arranged to lie in parallel directions to a line connecting the opposing holes 7 of the plate member 6 so as to extend vertical with respect to major axis of the rectangular casing 8 so that the heat which the fins 18 have received will be effectively rapidly transmitted to the casing 8 with less thermal transmission resistance. Further, the fins 18 are provided in a plurality of arrays A through D in the embodiment of FIG. 3 and are twisted in opposite directions in alternate ones of the arrays as seen in FIG. 6. That is, in the preferable arrangement of FIG. 3, the fins 18 in the arrays A and D are twisted in the same direction, whereas the fins 18 in the arrays B and C are twisted in the opposite direction to that in the array A or D. In remaining fields beside both longitudinal ends of the casing 8, the heat receiving plate member 6 is further provided with a plurality of slit-shaped apertures 20.

The operation of the present invention shall now be explained in the followings.

As the fire sensing device according to the present invention is installed on the ceiling surface on the side of the device body 1, the heated air flow ascending toward the ceiling surface will enter inside space of the covering 3 through the apertures 17 to hit the heat receiving plate member 6 and will leave the device through the sideward apertures 21, or the heated air flow coming along the ceiling surface will enter through the sideward apertures 21 on one side to hit the heat receiving plate member 6 as directed downward by the walls 5*a* and will leave through the apertures 21 on the other side or through the apertures 17. In this case, as the fins 18 of the heat receiving plate member 6 are raised as twisted in diagonal direction with respect to the plane of the plate member 6, the air flow hitting the plate member 6 further flows along the respective fins 18 which are providing a larger contacting surface area of the heat receiving plate member 6 than that of conventional one that has only slits or apertures, whereby the heat receiving plate member 6 can be heated effectively quickly. Further, as the fins 18 are arranged in a plurality of arrays in each of which the twisted directions are opposite to each other, the heated air flow coming along the ceiling surface or even along the plane of the heat receiving plate member 6 will be caused to flow through the apertures 19 and along both sides of the respective slits 18 from either side of the plate member 6, the air flow will effectively quickly transmit its heat to the member 6 regardless to the directivity of the air flow.

Referring to he twisted angle $\theta$ of the fins 18, it is noted that, in the case when the angle $\theta$ is so small as to be less than about 30°, the fins of such angle will rather render their resistance to the air flow to be larger without allowing the flow to pass through the slits between them and thus are unfavorable and, in the case when the angle $\theta$ is so large as to be more than about 70°, the air flow will mostly pass only over respective upraised edges of the fins without sufficiently contacting both surface areas of the fins so that the heat transmission efficiency of the fins will not be favorable. Therefore, it should be preferable that the twisting angle $\theta$ of the fins is determined to be in a range of about 40° to 60°, while the angle should have a relation to repetition pitch of the fins.

Referring to the pitch at which the fins are repetitively formed, it is necessary, for the purpose of establishing an excellent thermal transmission efficiency from the heated air flow to the heat receiving plate member, to provide the fins of the plate member with a smaller resistance to the heated air flow which will pass along the plate member and also to elevate contacting efficiency of the plate member specifically at the fins with the heated air flow. For this purpose, the pitch is preferably determined practically to be in a range of about 0.3 to 1.0 mm.

What is claimed is:

1. A fire sensing device for actuating fire alarm system comprising a base body, a heat-responsive switch mounted to said base body, and a heat receiving plate member thermally connected to said switch and expanding around the switch, said heat receiving plate member being provided therein with at least two groups of slits defined by fins formed by being raised from the plate member, said fins in each of said groups being raised respectively in the same direction, and said raised direction of the fins in each of the groups being different from that in the other groups.

2. A device according to claim 1 wherein said raised direction of the fins in each of the slit groups is opposite to that in the other adjacent groups.

3. A device according to claim 1 wherein said fins are respectively raised by an angle selected to be in a range of 40° to 60° with respect to expanding plane of the heat receiving plate member.

4. A device according to claim 1 wherein respective said slits are arranged in a first direction in most of the groups and in a second direction different from said first direction in the rest of the groups.

5. A device according to claim 1 wherein said heat receiving plate member is painted black.

* * * * *